United States Patent [19]

Martling

[11] 4,285,293

[45] Aug. 25, 1981

[54] COMBINED NEEDLE GUARD/NEEDLE COOLER FOR SEWING MACHINE

[75] Inventor: Wayne F. Martling, Oak Park, Ill.

[73] Assignee: Union Special Corporation, Chicago, Ill.

[21] Appl. No.: 88,746

[22] Filed: Oct. 26, 1979

[51] Int. Cl.[3] ..... D05B 71/04; D05B 83/00

[52] U.S. Cl. ..... 112/281; 112/261

[58] Field of Search ..... 112/281, 280, 270, 261

[56] References Cited

U.S. PATENT DOCUMENTS

| | | | |
|---|---|---|---|
| 1,269,711 | 6/1918 | Hoepner | 112/261 |
| 3,125,049 | 3/1964 | Redman | 112/261 X |
| 3,263,631 | 8/1966 | Freeman | 112/281 |
| 3,382,681 | 5/1968 | Hagg | 112/281 |

FOREIGN PATENT DOCUMENTS

| | | | |
|---|---|---|---|
| 1133225 | 1/1963 | Fed. Rep. of Germany | 112/281 |
| 315295 | 8/1956 | Switzerland | 112/281 |

*Primary Examiner*—H. Hampton Hunter

*Attorney, Agent, or Firm*—John W. Harbst; John A. Schaerli

[57] ABSTRACT

This disclosure relates to a device that is adapted to individually and simultaneously guard and cool each needle of a sewing machine. The device includes an apertured member that is adjustably secured to the frame of the machine in a position below the work support of the machine. The apertured member is adapted to receive the needle or needles during the lower portion of its stroke. The diameter of the needle receiving aperture or bore provides a camming or guarding surface against which the needle may impinge, in the event that on its downstroke the needle is deflected or bent in any direction away from its reciprocatory path. A passageway, formed in the member, allows for the transmission of a cooling medium to the needle receiving bore so as to cool the eye area and point of the needle as it passes therethrough.

7 Claims, 11 Drawing Figures

FIG. 6
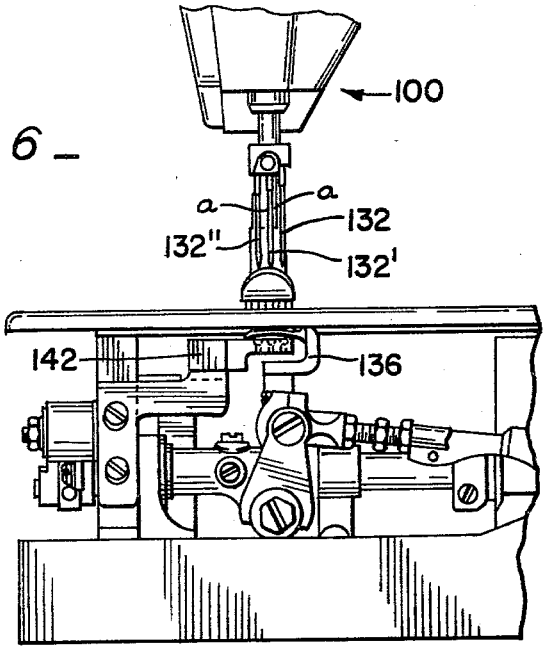
FIG. 10
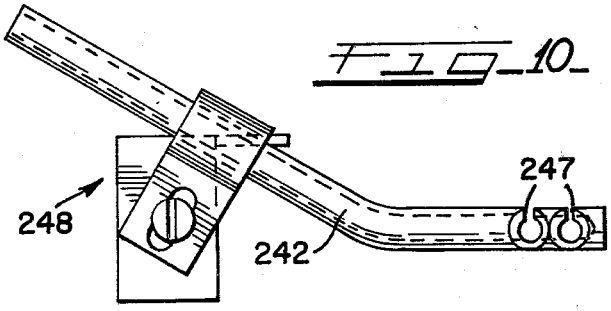
FIG. 11
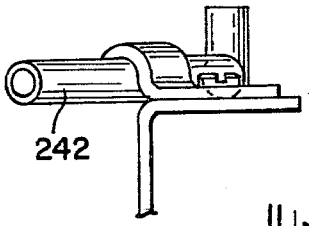
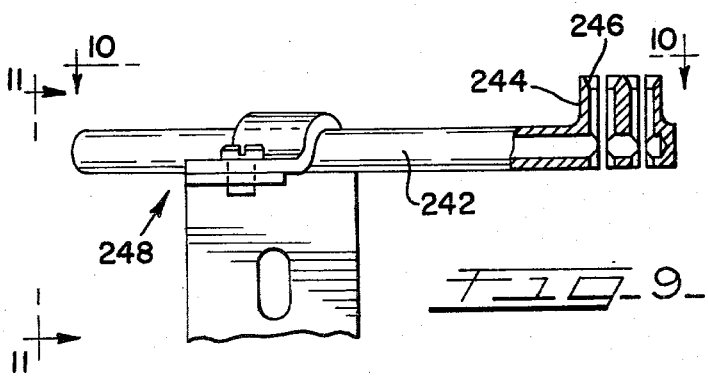
FIG. 9

COMBINED NEEDLE GUARD/NEEDLE COOLER FOR SEWING MACHINE

FIELD OF THE INVENTION

The present invention relates to sewing machines, and more particularly, to improved means for simultaneously guarding and cooling the needle or needles of a sewing machine.

BACKGROUND OF THE INVENTION

With practically and high speed industrial type sewing operation, and as is even more pronounced when dealing with heavy-weight work pieces, there are two inherent problems that adversely affect the sewing operation. The first problem is concerned with guarding and positioning the needle with respect to the lower stitch forming instrumentalities so as to prevent damage to the needle and/or lower stitch forming mechanism. The other problem is concerned with the prevention of excessive needle heat.

With regard to the first situation, needle guarding is necessary because as the needle reciprocates, it passes in close proximity to the loop taker element of the lower stitch forming mechanism. On its return stroke, the needle throws out a loop of thread which is seized by the loop taker element forming the desired stitch. In the event that the needle should become bent or deflected by irregularities in the material or the like, the needle may be displaced from its normal path which could result in skipped stitches of the needle striking the loop taker element and, thus, resulting in a scoring of the loop taker element or a breakage of the needle. The second problem, excessive heat of the needle, is caused by friction between the needle and the cloth. Excessive heat build-up may result in melting of the workpiece in certain instances or the breaking of the thread passing through the needle eye and will reduce considerably the ability of the needle to pierce the workpiece. The problem is accentuated because as the needle becomes duller, more heat is created as the needle attempts to pierce the material being worked on.

BRIEF DESCRIPTION OF THE INVENTION

To overcome the problems of excessive heat buildup and needle guarding, the present invention provides a new and unique means for simulataneously guarding and cooling each needle of the sewing machine. The combined needle guard/needle cooler constituting the present invention includes an apertured member that is positioned below the work support of the machine. Each needle of the machine is received in a bore or aperture formed in the member. The diameter of the bore, which closely approximates the diameter or size of the needle, completely surrounds each needle and acts as a camming or guarding surface against which the needle may impinge should it become deflected or bent on its downward stroke. The upper extremity of the needle receiving bore may be enlarged or tapered outwardly to form a guide that is adapted to deflect the point of the needle into the needle receiving bore if it should happen to be cut of alignment. A vertically disposed slot, which opens into the needle receiving bore, is positioned on the member so as to allow distention of the needle thread loop in its normal manner. A passageway, formed in said member, is provided for transmitting a cooling medium to each of the needle receiving bores whereat the cooling medium may be admitted against the needle so as to cool the point, eye area and a portion of the blade of the needle as it passes therethrough. Suitable bracket means may be provided for attaching the member means to the machine frame. The bracket may provide for selective adjustment of the needle receiving bore in any direction relative to the reciprocatory path of the needle.

In line with the above, a primary object of the present invention is the provision of suitable means for simultaneously guarding and cooling the needle or needles of a sewing machine.

Another object of this invention is to provide means for simultaneously guarding and cooling each needle of a sewing machine but is yet easily accessible for service or for alteration.

Another object of this invention is to provide a combined needle guard/needle cooler that is inexpensive to manufacture and to assemble and which efficiently and dependably performs its intended function.

The invention, still further, aims to provide means for simultaneously guarding and cooling the needle or needles of a sewing machine of the type adapted to operate upon heavy materials where there is a pronounced tendency of the needle to deflect from its normal path of travel and to become overheated.

With the above and other objects in view, as will hereinafter appear, the nature of the invention will be more clearly understood by reference to the following detailed description, the appended claims and the several views illustrated in the accompanying drawings in which;

FIG. 6 is a view similar to FIG. 1, but having a modified form of the invention mounted thereon;

FIG. 9 is an enlarged front elevational view, partially in section, showing still another modified version of the present invention;

FIG. 10 is a top plan view of the embodiment shown in FIG. 9;

FIG. 11 is an end elevational view of the invention shown in FIG. 10.

DETAILED DESCRIPTION OF THE INVENTION

Figure 1:
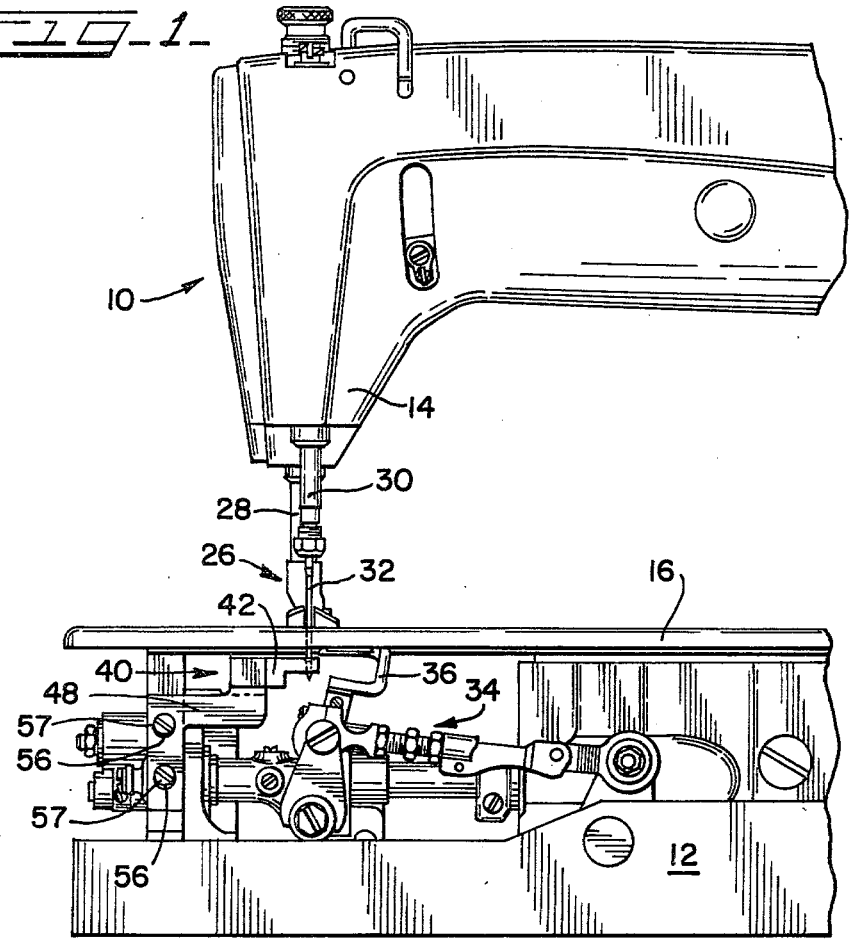
FIG. 1 is a partial front elevational view showing a machine embodying the invention.
Figure 2:
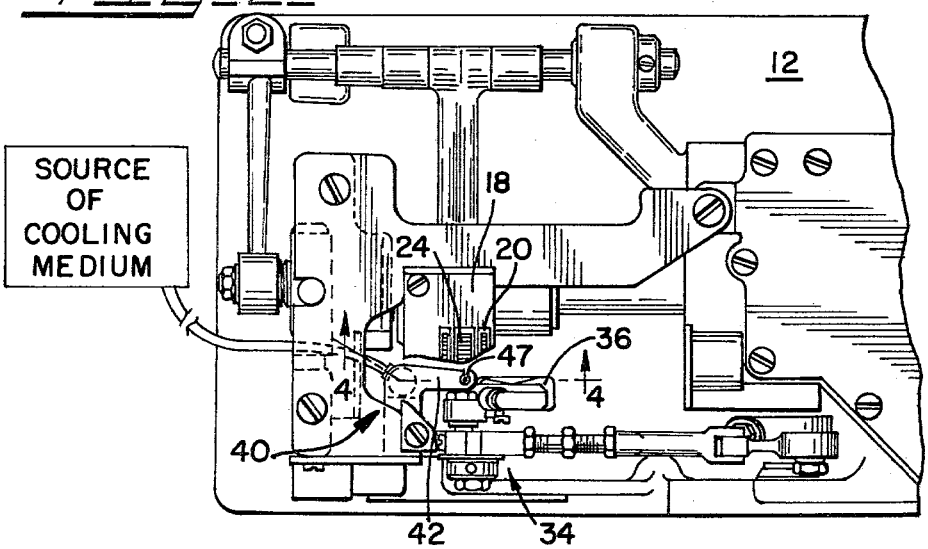
FIG. 2 shows a part of the opened machine bed of FIG. 1 viewed from above.

With reference to the drawings, the invention has been shown as embodied in a double locked stitch sewing machine 10. It should be appreciated, however, that the teachings of the present invention are equally applicable to other types of sewing machines and should not be limited to that shown in the drawings. In the first embodiment, illustrated in FIGS. 1 through 5, the machine has a bed or frame 12, a head 14 overhanging the bed, and a work support means 16 including a throat plate 18. The throat plate 18 includes suitable needle aperture means and slots 20 for receiving the feed dog 24 for advancing the material across the work support means. A presser foot assembly 26, carried on the lower end of a presser bar 28, forces the work piece against the upper surface of the throat plate 18. Suitably supported for endwise reciprocation in the head 14 is a needle bar 30. The lower end of the needle bar carries a thread carrying eye pointed needle 32. In the well known operation of the machine, the needle 32 passes through the workpiece and work support, thus carrying the needle thread through the work to a position below the throat plate. The needle 32 and thread carried thereby cooperate in the formation of stitches with a lower thread manipulated by a lower stitch forming mechanism 34. In the embodiment shown, the mechanism 34 includes, among other well-known elements, a loop taker 36 that is supported on a rocker arm 37 which arm is operatively connected to a suitable driving mechanism for reciprocating the loop taker in timed relation with the movement of a needle. The mechanism 34 is well-known in the art and, thus, need not be described in complete detail.

Figure 4:
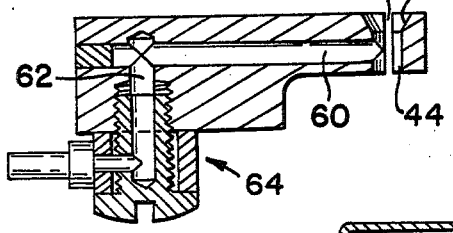
FIG. 4 is an enlarged sectional view taken substantially along line 4—4 of FIG. 2.
Figure 3:
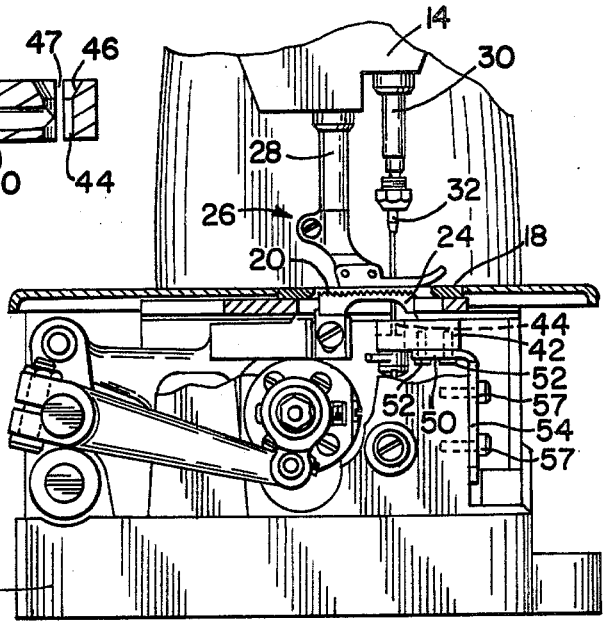
FIG. 3 represents a side elevational view, partially in section, showing a machine embodying the invention.
Figure 5:
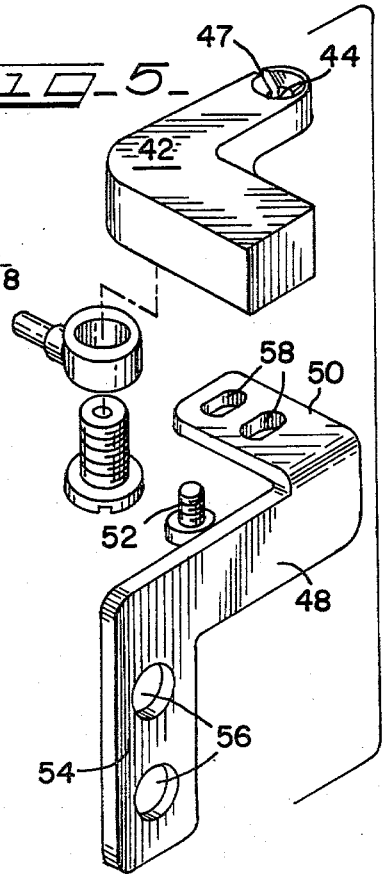
FIG. 5 is an enlarged exploded perspective view of the present invention.

As further illustrated in the drawings, there is provided a combined needle guard and needle cooling means generally designated by reference numeral 40. The combined needle guard/needle cooler includes a needle receiving member means 42 which is disposed below the recipricatory path of the loop taker 36. As best seen in FIGS. 4 and 5, the member means 42 is provided with an opening or bore 44 which extends through the member means 42 and is coaxially positioned relative to the reciprocatory path of the needle so as to receive and completely encompass a portion of the needle after it descends through the workpiece. In this manner, the diameter of the bore 44 acts as a camming or deflecting surface which is adapted, in the event that the needle is bent or deflected in any direction, to reposition the needle properly with respect to the lower stitch forming instrumentality 34. It should be appreciated, that the diameter of the bore 44 is just large enough to receive the needle and, more particularly, the needle eye area. In addition, the upper extremity of the bore 44 is enlarged or tapered outwardly as at 46 (FIG. 4) to form a guide adapted to deflect the point of the needle into the bore 44, if it should, for whatever reason, happen to be out of alignment.

The member means 42 is also formed with a vertically extending slot 47 which opens into the bore 44. The vertical slot 47 is dimensioned such that it is of less width than the diameter of the needle but larger than the diameter of the thread. As is appreciated by one skilled in the art, the slot 47 is located relative the needle so as to allow the distention of the needle thread loop upon retraction of the needle from its lower most position, thus allowing penetration thereof by the loop taker 36.

The needle receiving member means 42 is secured to the frame 12 by any suitable means such as bracket means 48. As shown in FIG. 5, the bracket means 48 may have a horizontally offset or extending portion 50 to which the member means 42 may be secured by fastening means 52. In the embodiment shown in FIG. 5, the depending leg 54 of the bracket 48 is provided with a plurality of enlarged aperatures 56 so that the bracket 48 may be adjustably secured to the frame by fastening means 57 (FIG. 1). The fastening means 57 are adapted to extend through the aperture 56 and are threaded or secured into the frame 12. This construction enables one to selectively secure the member means in a position as may be required by the constraints of the machine. Similarly, the offset portion 50 of the bracket 48 may be provided with horizontally elongated apertures 58, thus allowing the member means 42, and more particularly, the bore 44 therein, to be selectively positioned, if necessary, relative the reciprocatory path of the needle.

The apparatus for adequately cooling the needle will now be described. Arranged longitudinally of the member 42 and in communication at one end with the vertically extending bore means 44 is a channel or passageway 60 that extends practically the entire length of the member means 42. The channel 60 is arranged in communication at its other end with a conduit 62 that extends to the outward surface of the member 42. Through suitable well known means, designated generally be reference numeral 64, the conduit 62 and 60 are arranged in communication with a source of cooling medium. In this manner, a cooling medium may be transmitted by the passageways 62, 60, and admitted directly at the point, eye are and blade of the needle as it passes through the bore 44 whereby cooling same.

As is implied from its nomenclature, and as is described above, the combined needle guard/needle cooler is a device that serves a dual purpose. That is, the bore 44 provided in the member 42 is effectively disposed so as to surround the eye area and point of the downwardly moving needle, thus providing a guard for the needle against displacement in any direction regardless of the direction of feed. Secondly, as the needle is being guarded, it will simultaneously be cooled by a cooling medium that is directed against that portion of the needle encompassed by the member means 42 during the normal operation of the machine.

Figure 7:
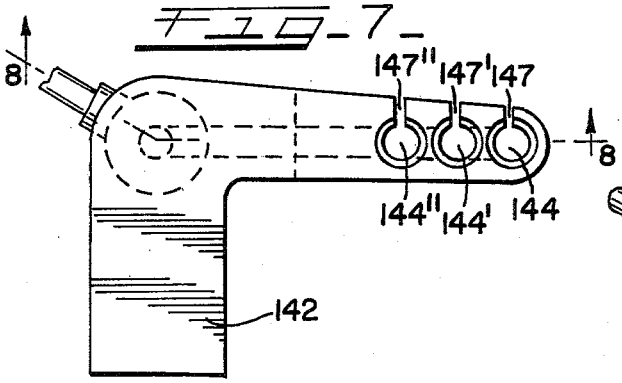
FIG. 7 is an enlarged top view showing the modified embodiment of a combined needle guard and needle cooler of FIG. 6 detached from the machine.
Figure 8:
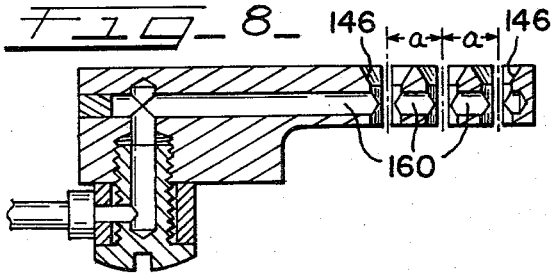
FIG. 8 is an enlarged front sectional view substantially taken along line 8—8 of FIG. 7.

FIGS. 6, 7 and 8 illustrate a second embodiment of a combined needle guard and needle cooler. This second embodiment is applicable to machine 100 having a plurality of needles, such as 132, 132', 132''. As is well known in the art, the needles are spaced apart by some distance or guage "a". The machine may be provided with one or more loop taker elements, one of which is generally designated by reference numeral 136. In this second embodiment, the combined needle guard and needle cooler includes a member 142. Suffice it to say that member 142 may be supported below the throat plate of the machine in a manner similar to that disclosed for member 42 discussed above. In this manner, the apertured member may be easily changed so as to allow for changes in needle size or needle spacing, etc. The member 142 is provided with a plurality of openings, 144, 144', 144'' that are spaced apart by a similar distance "a" and adapted to receive the needles on their downward stroke. The periphary of each of the bores or openings 144, 144', 144'' provide a circumferential guarding surface for engaging and directing the needles in the event that they are bent or flexed. The member means 142 is provided with a series of vertically disposed slots 147, 147', 147'', that open into the needle receiving bore and are adapted to allow distention of the needle thread loop upon retraction of the needle. In this manner, the proper cooperation of the needles and looper element may be insured. The upper extremity of each of the bores or openings may be enlarged as at 146 so as to deflect the point of the needle towards its respective guide or openings if it should happen to be misaligned therewith.

The member means 142 is provided with a longitudinal passageway 160 that may be arranged in communication with a source of cooling medium. It is important to note, however, that the passageway 160 is effective to deliver a cooling medium to each of the openings 144, 144', 144" provided in the member means 142. The manner of operation of this embodiment is, in principle, the same as that in the first described embodiment.

FIGS. 9, 10, and 11 illustrate a third embodiment of a combined needle guard and needle cooler. In this embodiment there is provided a horizontally disposed tubular conduit means 242 which is closed at one end. The other end may be operatively connected to a source of cooling medium that may, for convenience, be disposed remote from the machine. Additionally, the tubular member 242 may be curved so as to conform to the constraints of the machine on which it is employed. Suitable bracket and clamp means designated generally by reference numeral 248 may be utilized to secure the tubular member 242 to the machine fame and to position same below the lower stitch forming instrumentality of the machine. Upwardly extending and disposed at the closed end of the tubular member 242 may be one or more tubular members 244, the interior of which are arranged in operable communication with the interior of tubular member 242. The vertically disposed tubes 244 are open at their upper extremity and are adapted to receive the needle or needles of the machine during the lower portion of its stroke. As in the other embodiments, the upper extremity of the tubes 244 may be inclined or enlarged as at 246 so as to act as a guide for the point of the needle should it be deflected from its normal path of travel. As will be appreciated, the interior of the needle guard or tubes 244 acts as a camming surface for engaging in positioning the needle or needles with respect to the lower stitch forming instrumentality should it be deflected or bent in any direction away from its normal path of travel. Of course, suitable openings such as 247, which open into the interior of the tubular members 244 are provided so as to allow extension of the needle thread loop once the needle begins to rise from its lowermost position. The manner of operation of this embodiment is, in principle, the same as that described in the above described embodiments. Suffice it to say, that all three embodiments serve to individually and simultaneously guide and/or position the needle or needles of the machine and cool same during the normal operation of the machine.

Thus, it is apparent that there has been provided, in accordance with the invention, a combined needle guard/needle cooler for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. In combination with a sewing machine having a frame, work support means, a thread carrying needle adapted for endwise reciprocation during a sewing cycle, a lower stitch forming mechanism arranged to manipulate a lower thread and to cooperate with said needle in the formation of a stitch, an operable means for cooling and guarding the needle comprising:

member means extending beneath the work support means to a position in the reciprocatory path of said needle, said member means having a bore the diameter of which constitutes a camming surface which is adapted, in the event that on its downstroke the needle is deflected or bent in any direction away from its normal path, to reposition the needle properly with respect to the lower stitch forming means;

and means defining a passageway formed in said member means and opening into said bore for transmitting a cooling medium to the area in which said needle passes through said member whereby cooling same.

2. The invention as defined in claim 1 wherein means are provided for attaching said member to said frame, said attaching means being adjustable so that the bore in said member means may be selectively positioned with respect to the reciprocatory path of said needle.

3. In combination with a sewing machine having a reciprocatory needle bar including a plurality of needle means carried thereon each of which are arranged to manipulate a needle thread, lower thread carrying stitch forming mechanism means arranged to manipulate the lower threads and to cooperate with said needle means in the formation of stitches and means operative for simultaneously guarding and cooling each of said needle means comprising:

stationary guard means disposed in the reciprocatory path of said needle means and having a plurality of openings corresponding in number to the needle means, the periphery of each of said openings providing a circumferential guarding surface for respectfully engaging and directing the needle means in the event they are bent or flexed so as to insure proper cooperation of the needle means with the lower stitch forming mechanism means; and conduit means formed as an integral part of said guard means and adapted for communication with said openings for delivering a cooling medium and directing same against that portion of the needle means that passes through the openings.

4. In combination with a sewing machine having a frame, work support means, a reciprocatory needle movable through the work support means and adapted for cooperation with a lower stitch forming mechanism in the formation of a series of stitches in a workpiece, a means operative for simultaneously guarding and cooling said needle comprising:

stationary tubular needle guard means disposed beneath the work support means in the reciprocatory path of said needle and adapted to receive same, the interior of said tubular needle guard means acting as a camming surface for engaging and repositioning the needle with respect to the lower stitch forming mechanism should it be deflected or bent out of its normal reciprocatory path while travelling beneath the work support means; and conduit means adapted to deliver a cooling medium through the interior of said tubular means and admit same to the interior of said tubular needle guard means whereby cooling said needle as it passes therethrough.

5. The sewing machine according to claim 4 wherein provision is made in said tubular needle guard means of a narrow vertical slot means the width of which is less than the diameter of the needle but greater than the diameter of the thread and opening into the interior of said tubular guard means for allowing distention of the needle thread loop in the usual manner.

6. In a sewing machine having a frame, work support means, reciprocatory thread carrying needle means, complementary means cooperating with said needle means for producing a stitch in a workpiece and means operative for simultaneously guarding and cooling said needle comprising:

member means disposed beneath said work support means in the reciprocatory path of said needle means and having an opening the diameter of which is effective to engage and reposition the needle in the event that it is bent or flexed so as to insure cooperation of said needle with said complementary means; and said member means being provided with channels that are in communication with said opening and adapted to transmit a cooling medium to that portion of the needle encompassed by said opening.

7. The invention as recited in claim 6, wherein said means operative is secured to the frame of the machine by adjustable means which provides for selection of the level of said member with respect to said work support means.

* * * * *